US006393132B1

(12) United States Patent
Lin

(10) Patent No.: US 6,393,132 B1
(45) Date of Patent: May 21, 2002

(54) SPEAKER

(75) Inventor: Chun-Yi Lin, Hsin Chuang (TW)

(73) Assignee: Jih Yo Electronic Co., Ltd. (TW)

( * ) Notice: Subject to any disclaimer, the term of this patent is extended or adjusted under 35 U.S.C. 154(b) by 0 days.

(21) Appl. No.: 09/484,733

(22) Filed: Jan. 18, 2000

(51) Int. Cl.[7] ..... H04R 25/00

(52) U.S. Cl. ..... 381/386; 381/182; 381/186; 381/396; 381/335; 181/144

(58) Field of Search ..... 381/182, 184, 381/186, 335, 386, 396, 401, 402; 181/199, 144, 163, 153, 165, 148, 147

(56) References Cited

U.S. PATENT DOCUMENTS 4,492,826 A * 1/1985 Chiu
4,552,242 A * 11/1985 Kashiwababa ..... 181/144
4,821,331 A * 4/1989 Murayama et al. ..... 381/192
4,837,839 A * 6/1989 Andrews ..... 381/199
5,548,657 A * 8/1996 Fincham ..... 381/182
5,568,562 A * 10/1996 Huang ..... 381/186
5,629,501 A * 5/1997 Fenton ..... 181/144
5,739,480 A * 4/1998 Lin ..... 181/144
6,002,780 A * 12/1999 Espirito ..... 381/182
6,095,278 A * 8/2000 Lin ..... 181/148
6,101,262 A * 8/2000 Haase et al. ..... 381/386

* cited by examiner

*Primary Examiner*—Sinh Tran
*Assistant Examiner*—P. Dabney
(74) *Attorney, Agent, or Firm*—Ostrolenk, Faber, Gerb & Soffen, LLP

(57) ABSTRACT

A speaker having a tweeter and a woofer together is disclosed. The tweeter can be selectively chosen to combine with the woofer or not, such that a user will have much more choices when mount the speaker. That is, the user is able to decide his/her own style of speaker according to where the user wants to locate the speaker, which increase the variety of decoration and also reduces the volume of the speaker.

3 Claims, 6 Drawing Sheets

SPEAKER

BACKGROUND OF THE INVENTION

1. Field of the Invention

The present invention relates to a speaker, and more particularly to a tweeter which is able to be securely attached to a woofer so as to save space and facilitate the transportation thereof.

2. Description of Related Art

Submersing oneself to a good music is quite an enjoyment, especially when the audio equipment can really remaster the real sound. To achieve the requirement, one must have a woofer and a tweeter. Normally, the tweeter is separate from the woofer, which is now not suitable to meet the user's requirement. To overcome the drawback, one kind of speaker having the tweeter and the woofer together is introduced to the market to meet the user's requirement. However, since the volume of the speaker is too large to be moved around, such that this kind of speaker is not satisfactory. Furthermore, having the tweeter and the woofer together still has other problems, such as the speaker can not fit into a specific location i.e. the wall or the car or the reliability between the attachment between the tweeter and the woofer is low, which often causes damage to the speaker.

To overcome the drawbacks, an improved speaker is introduced to obviate and/or mitigate aforementioned problems.

SUMMARY OF THE INVENTION

The main objective of the invention is to provide an improved speaker having the tweeter and the woofer selectively attached together, such that the user is able to use the speaker according to his/her own need.

To achieve the purpose, the speaker has a tweeter and a woofer securely attached together. The tweeter has a dome on a top thereof, a first base integrally formed under the dome and a extension securely extending out from a periphery of the base. The woofer has a circular frame with a through hole defined therethrough for receiving in the top portion thereof a second base and a support in the bottom portion thereof. The first base of the tweeter is securely received in the second base and the second base is securely received in the through hole of the circular frame, such that the tweeter and the woofer are able to be attached with each other to form a compact speaker.

Other objects, advantages and novel features of the invention will become more apparent from the following detailed description when taken in conjunction with the accompanying drawings.

DETAILED DESCRIPTION OF PREFERRED EMBODIMENT

Figure 1:
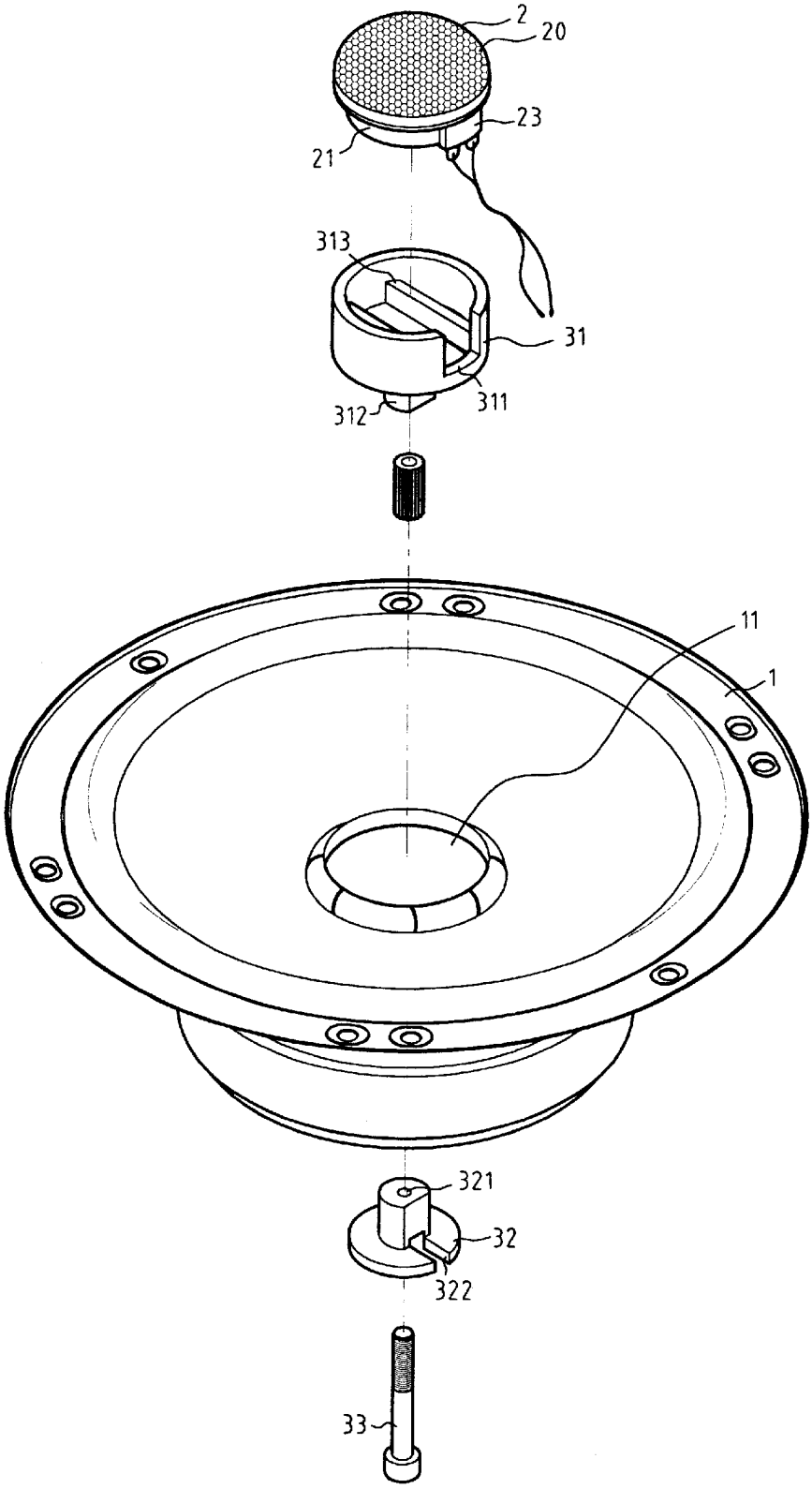
FIG. 1 is an exploded perspective view of a tweeter and a woofer in accordance with the present invention.
Figure 2:
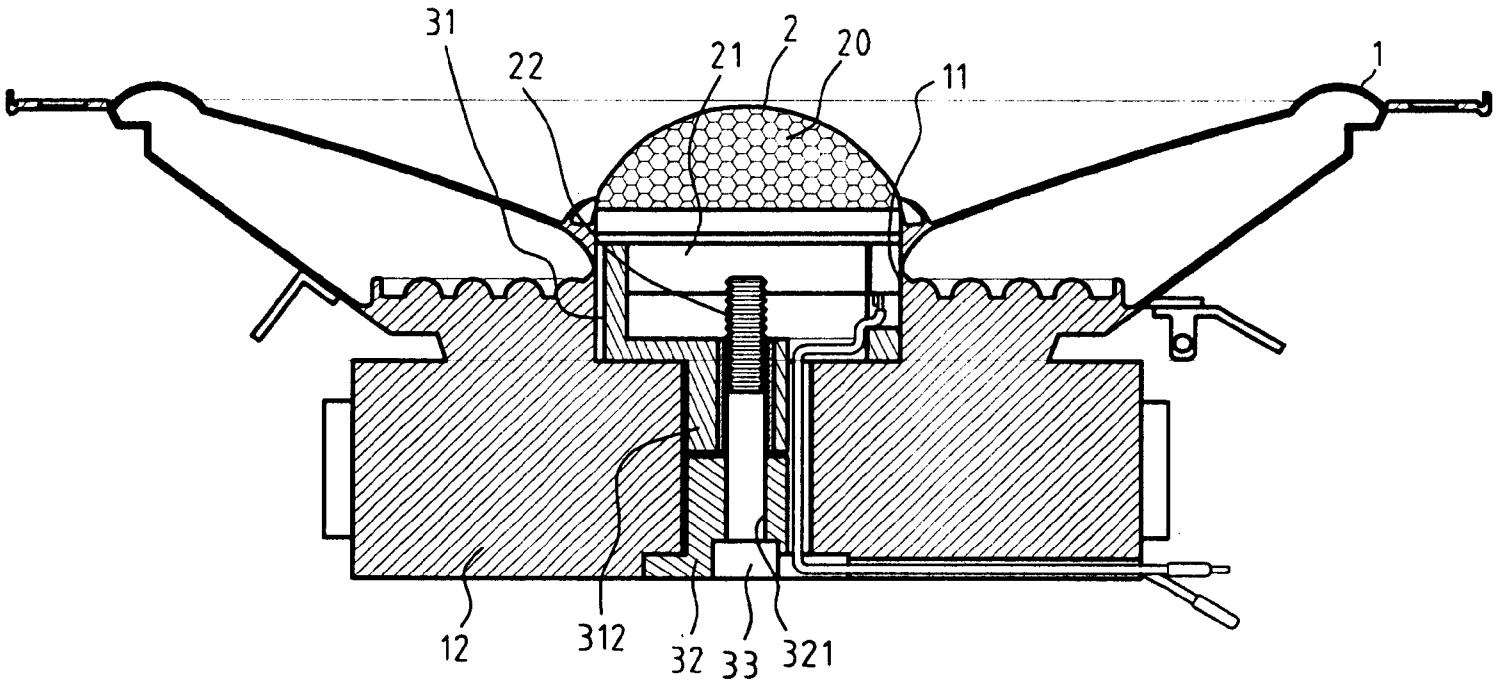
FIG. 2 is a cross sectional view showing that the tweeter and the woofer are attached with each other.

Referring to FIGS. 1 and 2, it is noted that a speaker in accordance with the present invention has a tweeter (2) and a woofer (1) securely attached together. The tweeter (2) has a dome (20) on a top thereof, a first base (21) integrally formed under the dome (20), a screw hole (22) defined in a bottom face of the first base (21) and an extension (23) securely extending out from a periphery of the first base (21) for a pair of wiring to extend out therefrom. The woofer (1) is a circular frame with a through hole (11) defined therethrough for receiving in the top portion thereof a second base (31) and a support (32) in the bottom portion thereof. The second base (31) has a cutout (311) defined in a side face thereof to correspond to the extension (23) of the tweeter (2), a positioning bar (312) integrally formed to be connected with a magnet (12) within the woofer (1) and transverse bars (313) formed inside the second base (31) for isolation of the tweeter (2) from the woofer for the magnetic influence when the tweeter (2) is attached with the woofer (1). The support (32) has a hole (321) defined therethrough and a slot (322) defined to correspond to the cutout (311) of the second base (31).

When the tweeter (2) is about to connect with the woofer (1), the tweeter (2) is first placed in the second base (31) and the second base (31) is placed in the top portion of the through hole (11) in the woofer (1). After which, the support (32) is received in the bottom portion of the through hole (11) and a bolt (33) is used to extend through the hole (321) of the support (32), the bottom face of the second base (31) and into the screw hole (22) of the tweeter (2), such that the tweeter (2) is securely connect with the woofer (1) and form a compact size.

If the tweeter (2) is to be separated from the woofer (1) and is used alone, the tweeter (2) is then connected with a collar (4) and a cover (42). The collar (4) has a cutout (41) defined to correspond to the extension (23) and a slit (411). The cover (42) is circular and has a plurality of protrusions (421) formed on the outer periphery thereof, a notch (422) defined to correspond to the cutout (41) of the collar (4) and the extension (23) of the tweeter (2) and multiple holes (423). When the tweeter (2) is to be used, the cover (42) is first mounted on an object by the assistance of multiple screws (43) each threadingly inserted into one of the multiple holes (423). Because an diameter of the collar (4) is tapered and the top portion of the tweeter (2) is a dome (20), the tweeter (2) is able to be snugly fitted in the collar (4) with the cutout (41) corresponding to the extension (23).

Figure 3:
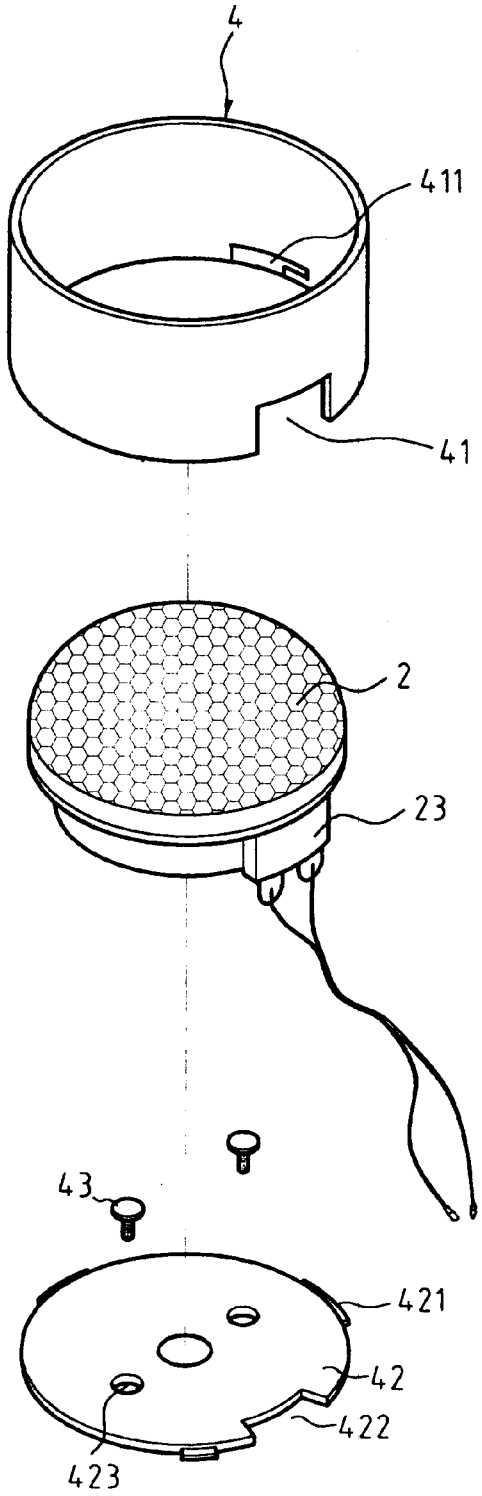
FIG. 3 is an exploded perspective view of the tweeter of another preferred embodiment.
Figure 4:
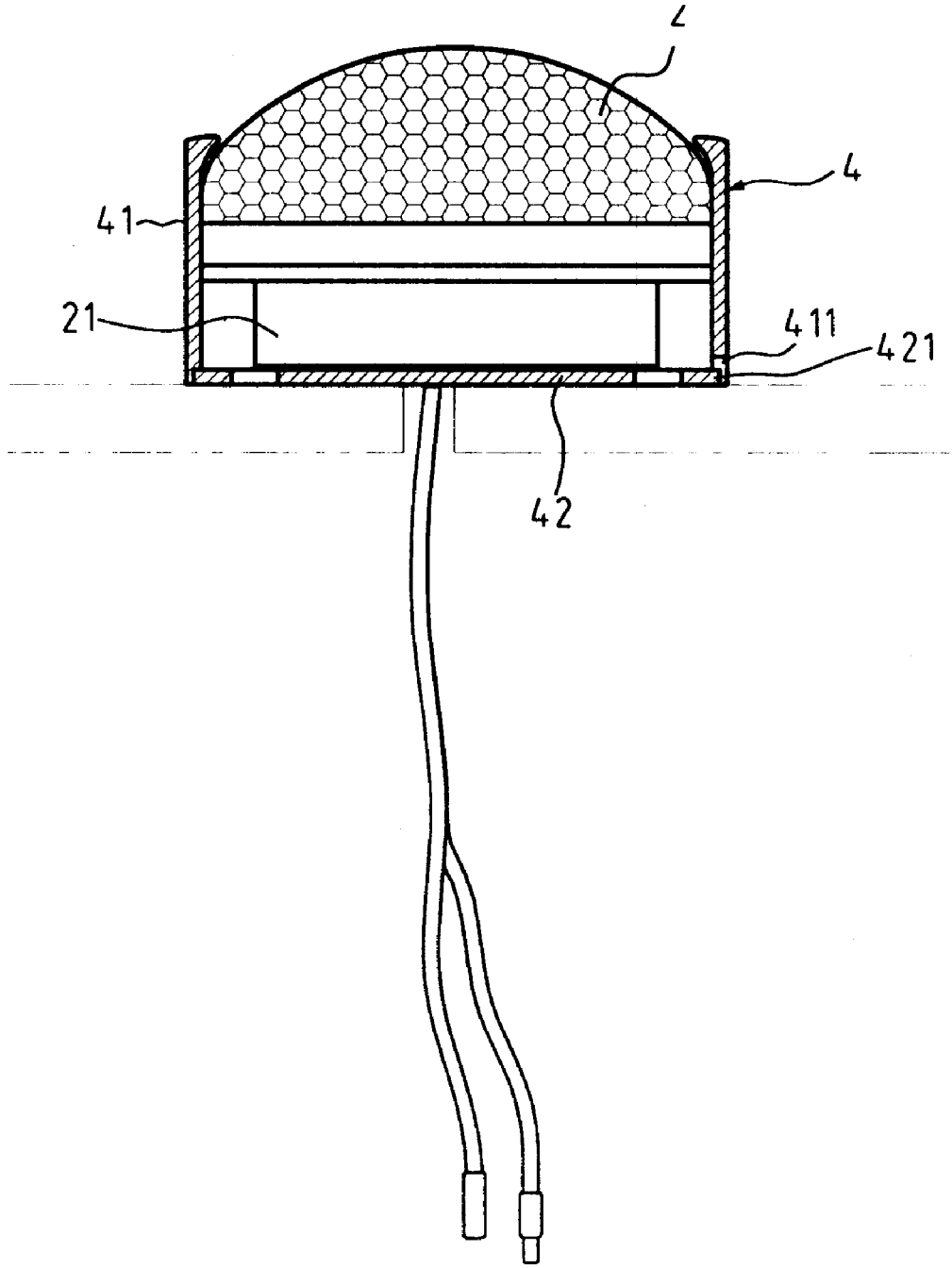
FIG. 4 is a side view with a collar shown in FIG. 3 in cross section.

After the tweeter (2) is received in the collar (4), the cover (42) is securely connected with the collar (4) by inserting the protrusions (421) of the cover (42) into the slit (411) and rotating the collar (4) so as to retain the protrusions (421) within one of the multiple slits (411), as shown in FIGS. 3 and 4.

Figure 5:
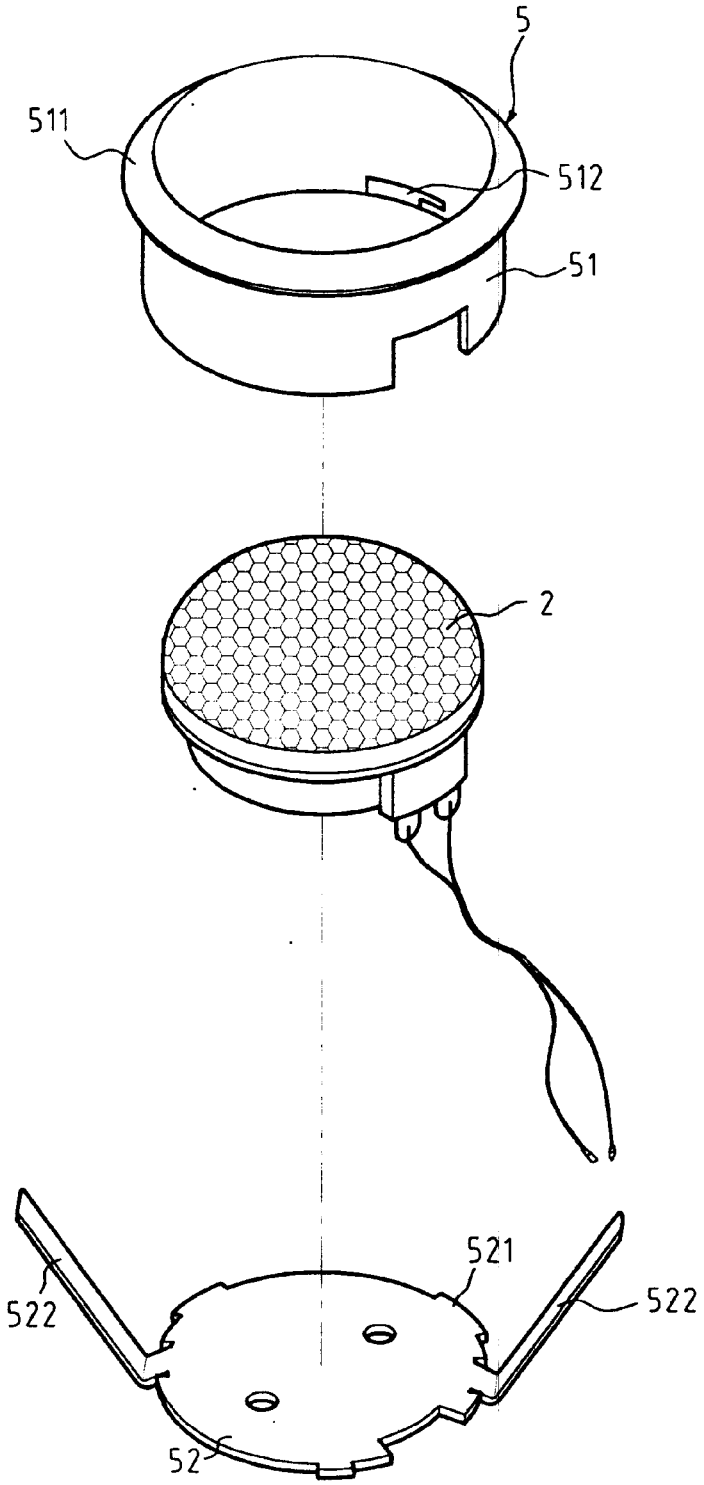
FIG. 5 is an exploded perspective view of the tweeter of still another embodiment.
Figure 6:
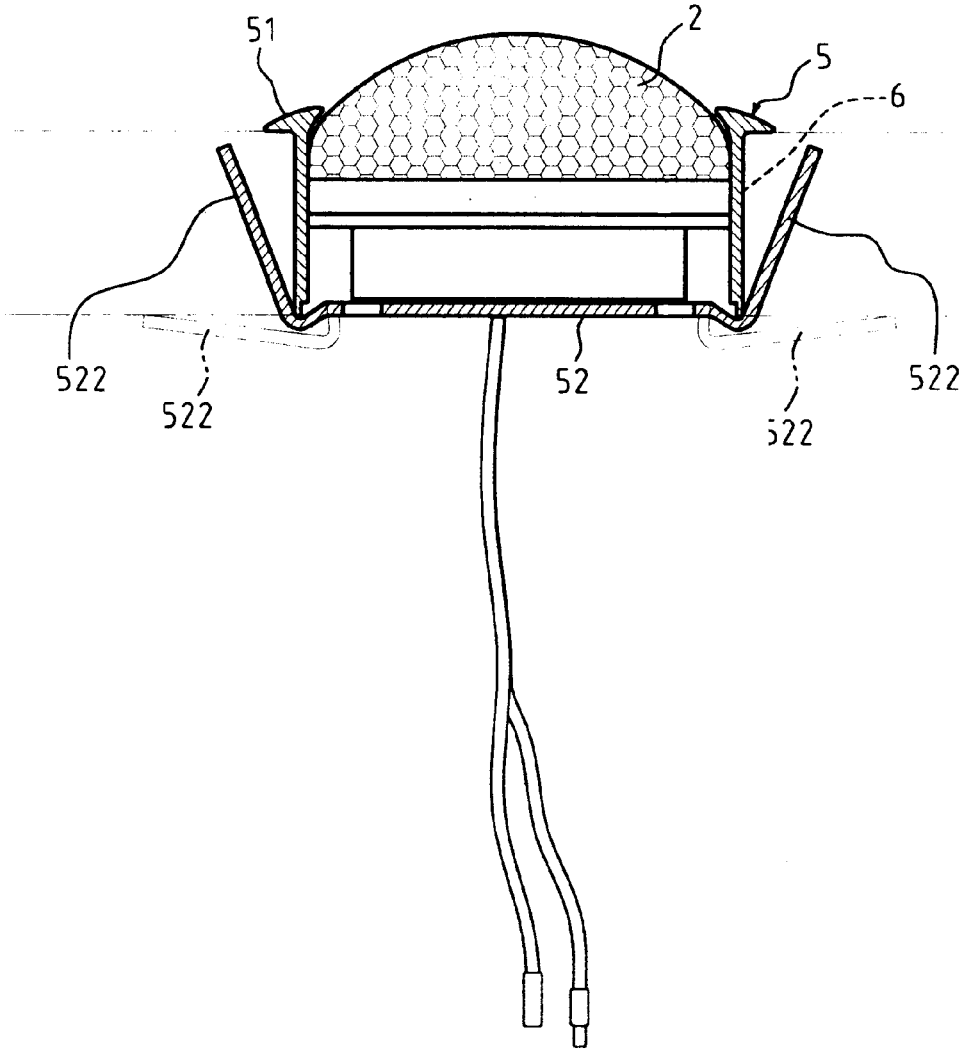
FIG. 6 is a side view with the collar and a retainer in cross section.

FIGS. 5 and 6 show another embodiment for holding the tweeter (2). Still, if the tweeter (2) is to be used alone, the tweeter (2) is combined with a holding device (5). The holding device has a collar (51) with a flange (511) formed on one edge thereof and multiple L-shaped slits (512), and a cover (52) with multiple protrusions (521) each formed to correspond to one of the slits (512) and at least two legs (522) extending out therefrom. It is to be noted that in this embodiment, the tweeter (2) had better be mounted onto a board with a hole (6). Therefore, after the tweeter (2) is connected with the collar (51) and each of the protrusions (521) are received in the corresponding one of the slits (512), the tweeter (2) and the holding device (5) is inserted into the hole (6) defined in the board. While inserting the collar (51) together with the tweeter (2) and the cover (52), the legs (522) spread out from a side face of the board as the flange (511) abuts a face defining the hole (6) to prevent the tweeter (2) together with the collar (51) from falling. With such an arrangement, the tweeter (2) is able to be presented without the assistance of the woofer (1).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A speaker having a tweeter and a woofer, wherein the improvements comprises:

the tweeter (2) has a dome (20) on a top thereof, a first base (21) integrally formed under the dome (20), a screw hole (22) defined in a bottom face of the first base (21) and an extension (23) securely extending out from a periphery of the first base (21) for a pair of wiring to extend out therefrom;

the woofer (1) is a circular frame with a through hole (11) defined therethrough for receiving in a top portion thereof a second base (31) and a support (32) in the bottom portion thereof;

wherein the second base (31) has a cutout (311) defined in a side face thereof to correspond to the extension (23) of the tweeter (2), a positioning bar (312) integrally formed to be connected with a magnet (12) within the woofer (1) and transverse bars (313) formed inside the second base (31) for isolation of the tweeter (2) from the magnetic influence of the woofer (1);

wherein the support (32) has a hole (321) defined therethrough and a slot (322) defined to correspond to the cutout (311) of the second base (31).

2. A speaker having a tweeter and a collar for mounting the tweeter, wherein the improvements comprises:

the tweeter (2) has a dome (20) on a top thereof, a first base (21) integrally formed under the dome (20) and an extension (23) securely extending out from a periphery of the first base (21) for a pair of wiring to extend out therefrom;

the collar (4) is tapered and has a cutout (41) defined to correspond to the extension (23) and at least one slit (411);

wherein a cover (42) is further provided and has a plurality of protrusions (421) each formed on the outer periphery thereof to correspond to one of the slits (411), a notch (422) defined to correspond to the cutout (41) of the collar (4) and the extension (23) of the tweeter (2) and multiple holes (423);

whereby the tweeter is received within the collar (4) and mounted onto an object by the assistance of the cover (42).

3. A speaker having a tweeter and a collar for mounting the tweeter, wherein the improvements comprises:

the tweeter (2) has a dome (20) on a top thereof, a first base (21) integrally formed under the dome (20) and an extension (23) securely extending out from a periphery of the first base (21) for a pair of wiring to extend out therefrom;

the collar (5) is tapered and has a flange (511) formed on one edge thereof and multiple L-shaped slits (512), and a cover (52) with multiple protrusions (521) each formed to correspond to one of the slits (512) and at least two legs (522) extending out therefrom;

whereby the flange (511) abuts a face of an object and the legs abut opposite face of the object so as to hold the tweeter in place.

* * * * *